US010010115B2

(12) United States Patent
Carlson et al.

(10) Patent No.: US 10,010,115 B2
(45) Date of Patent: Jul. 3, 2018

(54) SHIRT POCKET CONSTRUCTION

(71) Applicants: Richard H. Carlson, Asheville, NC (US); Margaret A. Carlson, Asheville, NC (US)

(72) Inventors: Richard H. Carlson, Asheville, NC (US); Margaret A. Carlson, Asheville, NC (US)

( * ) Notice: Subject to any disclaimer, the term of this patent is extended or adjusted under 35 U.S.C. 154(b) by 69 days.

(21) Appl. No.: 15/082,429

(22) Filed: Mar. 28, 2016

(65) Prior Publication Data

US 2016/0286866 A1 Oct. 6, 2016

Related U.S. Application Data

(60) Provisional application No. 62/140,719, filed on Mar. 31, 2015.

(51) Int. Cl.
*A41B 1/08* (2006.01)
*A41D 27/20* (2006.01)

(52) U.S. Cl.
CPC ..... *A41B 1/08* (2013.01); *A41D 27/205* (2013.01)

(58) Field of Classification Search
CPC ..... A41D 27/205
See application file for complete search history.

(56) References Cited

U.S. PATENT DOCUMENTS 9,247,776 B1 * 2/2016 Kim ..... A41D 27/205
2008/0196140 A1 * 8/2008 Mayerson ..... A41D 1/04 2/84
2008/0222780 A1 * 9/2008 Johnson ..... A41D 27/205 2/251
2011/0231980 A1 * 9/2011 Chen ..... A41B 1/10 2/96
2011/0307991 A1 * 12/2011 Writt ..... A41D 1/002 2/69
2012/0054939 A1 * 3/2012 Chow ..... A41D 27/205 2/69
2012/0186000 A1 * 7/2012 Raviv ..... A41B 1/00 2/247
2015/0082516 A1 * 3/2015 Doan ..... A41D 27/205 2/220
2015/0216245 A1 * 8/2015 Kinsley ..... A41D 27/205 2/212
2016/0095372 A1 * 4/2016 Peterson ..... A41D 27/201 2/248
2016/0235146 A1 * 8/2016 Kim ..... A41D 27/205
2016/0286866 A1 * 10/2016 Carlson ..... A41B 1/08

* cited by examiner

*Primary Examiner* — Shaun R Hurley
*Assistant Examiner* — Andrew W Sutton
(74) *Attorney, Agent, or Firm* — Leason Ellis LLP

(57) ABSTRACT

A shirt construction includes a pocket that is strategically located and constructed to hold an object, such as a mobile device (e.g., a smart phone). The pocket is a side pocket that is located along one side of the shirt below an armhole thereof such that when the wearer's arm is in a normal lowered position, the upper arm covers and can apply a force to the outside of the side pocket and/or to the object contained in the side pocket, thereby ensuring that the object remains in place within the side pocket.

10 Claims, 13 Drawing Sheets

SHIRT POCKET CONSTRUCTION

CROSS REFERENCE TO RELATED APPLICATION

The present invention claims priority to U.S. provisional patent application Ser. No. 62/140,719, filed Mar. 31, 2015, which is hereby incorporated by reference in its entirety.

TECHNICAL FIELD

The present invention is directed to garment construction and more particularly, is directed to a shirt construction that includes a pocket that is strategically located and constructed to hold an object, such as a mobile device (e.g., a smart phone).

BACKGROUND

Many garments, such as shirts, include one or more pockets that are used to store items, such as keys, a wallet, coins, etc. Over the recent years, the use of personal electronics has increased tremendously including the use of mobile devices. One of the most popular types of mobile devices is a sophisticated type of cellular phone that is commonly known as a smart phone.

While women typically carry a smart phone in a pocketbook or bag, it is more difficult for men to carry a smart phone, especially in warmer weather when a jacket is not needed. Placement of the smart phone in a pants pocket is not an ideal solution since the front pocket is too small for receiving the smart phone and would lead to discomfort and if the smart phone is placed in the back pocket, the wearer cannot sit down without removing the smart phone. If a person places the smart phone in a traditional front pocket of a shirt, the smart phone can easily fall out when the slightest bending action occurs. For example, if the wearer leans or bends forward, the smart phone will easily fall out given to its significant size and weight. This can result in damage to the smart phone.

The present invention is desired to overcome the above deficiencies.

SUMMARY

The present invention is directed to a shirt construction that includes a pocket that is strategically located and constructed to hold an object, such as a mobile device (e.g., a smart phone). The pocket is a side pocket that is located along one side of the shirt below an armhole thereof such that when the wearer's arm is in a normal lowered position, the upper arm covers and can apply a force to the outside of the side pocket and/or to the object contained in the side pocket, thereby ensuring that the object remains in place within the side pocket.

BRIEF DESCRIPTION OF DRAWING FIGURES

DETAILED DESCRIPTION OF CERTAIN EMBODIMENTS

Figure 1:
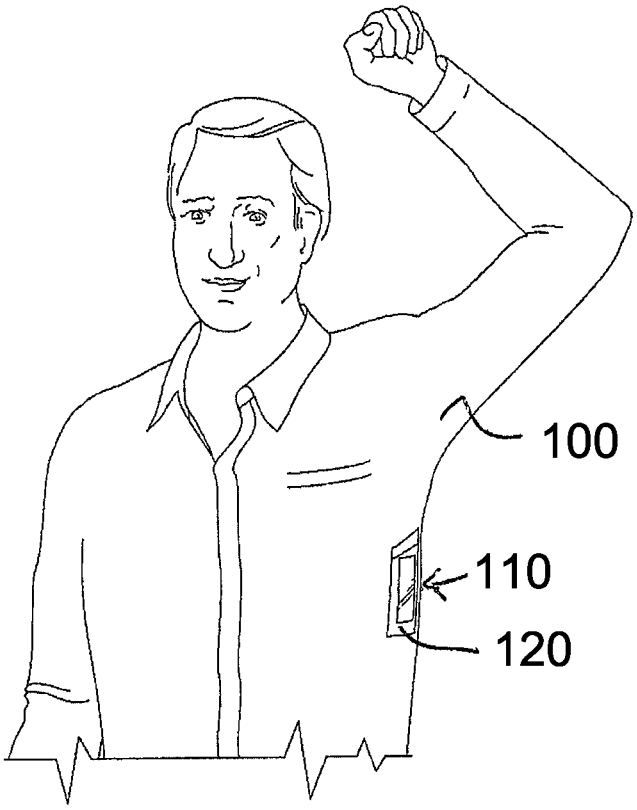
FIG. 1 is a front perspective view of a shirt showing a side pocket construction according to one embodiment of the present invention.

FIG. 1 illustrates a shirt 100 in accordance with one embodiment of the present invention. The shirt 100 can be any number of different types of shirts and can be formed of any number of different materials including but not limited to natural materials, such as cotton, and synthetic materials.

The shirt 100 illustrated in FIG. 1 is of a dress type and can have a traditional construction. A traditional shirt, such as shirt 100, is formed of a number of parts that are combined to form the finished product. The shirt 100 has a front portion which is formed of the following parts: (1) collar: the fold of fabric that makes up the neckline of the shirt. There are numerous variations of the dress shirt collar, but the three most common are the point, the spread, and the button-down; (2) placket: the panel of fabric that runs down the middle of the shirt where the buttons are sewn. There are three types: standard, seamless, and concealed; and (3) cuff: Band of fabric that finishes the bottom of the sleeve. Like collars, cuffs come in an array of styles, but the two to know are barrel (closed with buttons) and French (closed with cufflinks). The shirt 100 has a back portion which is formed of a yoke which is the shaped piece of fabric that runs from the neck to the shoulders. For greater ease of movement, the fabric can be divided into two pieces, called a "split-yoke."

The shirt 100 can also include a traditional front pocket. In accordance with the present invention, the shirt 100 also includes a side pocket 110. Most shirts 100, including dress shirts, have a pair of side seams that run along the opposing sides of the shirt 100. The side pocket 110 is formed of a front pocket fabric (panel or finishing layer) 120 which is a piece of material (a fabric) that is attached to the shirt using conventional techniques, such as stitching, etc. More particularly, the pocket fabric (panel) 120 is attached to the shirt along the edges of the panel 120 except for the top thereof to allow and to form an open entrance into the pocket. When the pocket panel 120 is attached to the front of the shirt 100, a space is formed therebetween (the pocket) which can carry objects, such as a pen or handkerchief. The side pocket 110 thus has an opening formed along its top to allow access to the open interior of the side pocket 110.

As described herein, the present invention is thus directed to the incorporation of one of the side pockets disclosed herein in a garment, such as a T-shirt, a work shirt, sweat shirt, dress shirt, formal dress shirt, a casual shirt, etc.

In accordance with the present invention, the side pocket 110 is strategically located below the armpit of the wearer. The purpose of the side pocket 110 is to hold an object, especially, a mobile device 10 (e.g., smart phone) in a secure manner, keep it clean, keep it safe, and keep it available in an inconspicuous manner.

The side pocket 110 can thus be positioned such that it extends across a side seam of the shirt 100 if present and is generally located along the side of the shirt 100. The side pocket 110 is positioned such that when the arm of the user is in a down position, the arm applies a force to the shirt 100 and more particularly, the upper arm naturally lies over the side pocket 110 of the shirt 100 and can thus serve to contain any object, such as a mobile device, that is inserted into the side pocket 110. The upper arm can thus cover the opening of the side pocket 110 and therefore, the contents of the side pocket 110 are securely maintained in the pocket, For tradesmen, such as electricians, carpenters, delivery men, maintenance men and many others, phone safety and accessibility is a special problem. These individuals do not have a convenient, safe place to carry a mobile device on the job site. If a phone is placed in a front pocket of a work shirt and the person bends over to pick up and object or perform a task, the weight and size of the mobile device causes the mobile device to fall out of the pocket.

The positioning of the side pocket 110 significantly reduces or eliminates the risk that the mobile device will fall out when the person (shirt wearer) leans over or assumes another position in which the object would tend to fall out if the object was in a traditional front pocket. It will be appreciated that even when a wearer leans over, the upper arm most often is in close proximity to the side of the body and thus, is in close proximity to the side pocket 110 and as a result, the upper arm assists in maintaining the object within the side pocket 110. Moreover, during a normal walking movement, the upper arm of the wearer is in close proximity to the side pocket 110 and the object remains securely contained in the side pocket 110.

Figure 2:
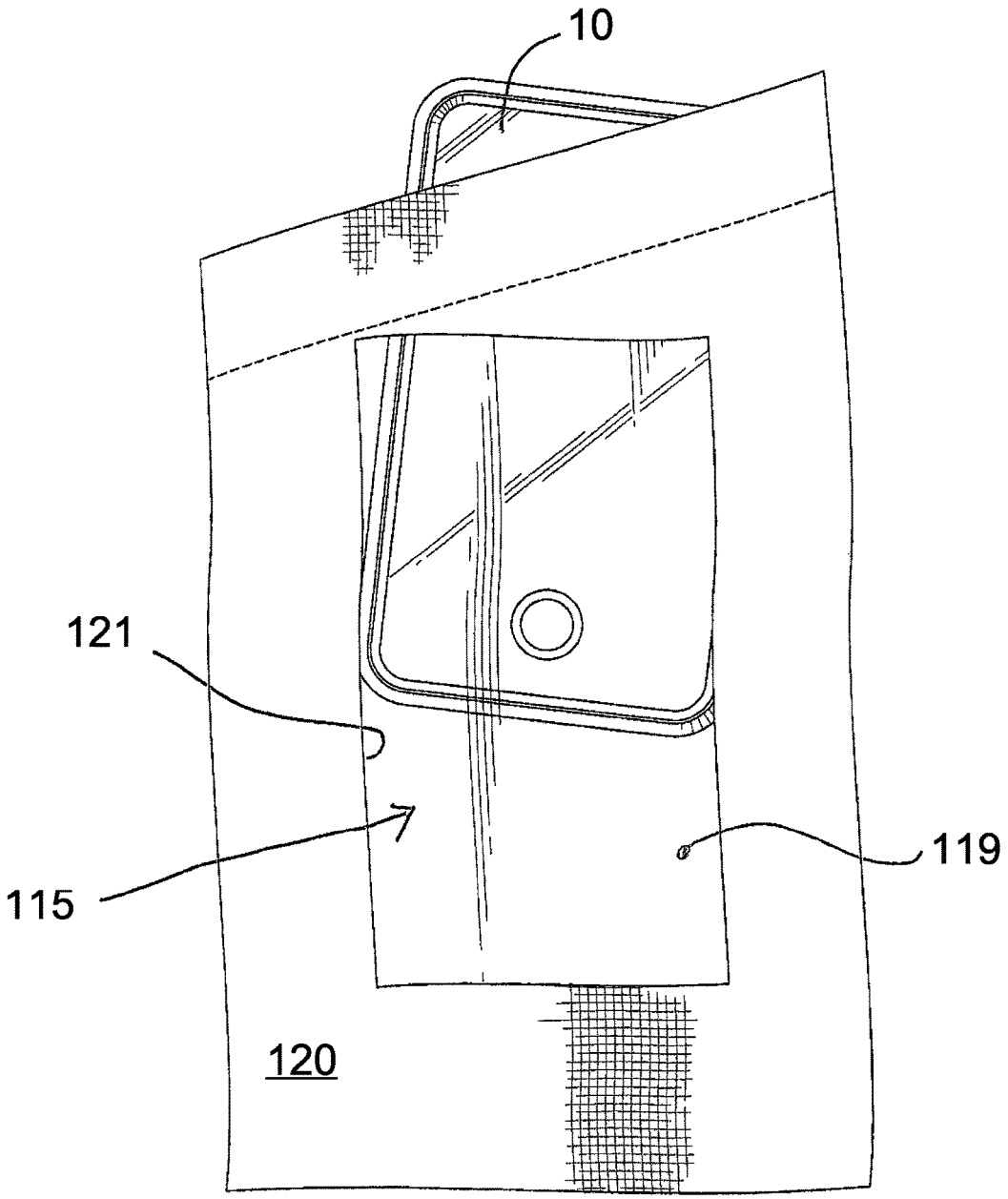
FIG. 2 is a front elevation view of the side pocket construction of FIG. 1.

In accordance with the present invention, FIGS. 1-2 show a side pocket 110 according to one embodiment. The side pocket 110 has a window 115 as a part thereof. The window 115 includes a layer of transparent or translucent material 119 that allows the object within the side pocket 110 to be visible. The panel 120 is typically formed of the same material that is used to form the rest of the shirt 100. The panel 120 is thus formed of a fabric material. The layer 119 most likely will be formed of a material that is different from the material that is used to form the panel 120. The layer 119 can be formed of any number of different materials that have the desired properties and are suitable for use in a garment. For example, a thin flexible film (plastic film) can be used to form the layer 119. The panel 120 is constructed to have an opening 121 which in part defines the window 115. The layer 119 is disposed over the opening 121 and is attached along the inner surface of the panel 120 so as to close off the opening 121. Any number of techniques for attaching the layer 119 to the panel 120 can be used such as sewing, using adhesives, bond agents, fasteners, etc.

The window 115 allows the wearer of the shirt to easily see the display screen of the mobile device. For example, if the wearer's hands are engaged and the mobile device receives an incoming call, the wearer can simply look down and view the screen and see the identity of the caller.

It will also be appreciated that the layer 119 can also be formed of a material that allows the wearer to interact with the mobile device by touching the device through the layer 119. For example, the wearer can touch a touch screen and/or touch buttons.

In a number of the figures, the top edge of the pocket 110 defined by the top edge of the panel 120 is shown as being angled. It will be appreciated that this construction is merely one exemplary construction and the pocket 110 can equally have a flat top edge as in traditional pockets.

Figure 3:
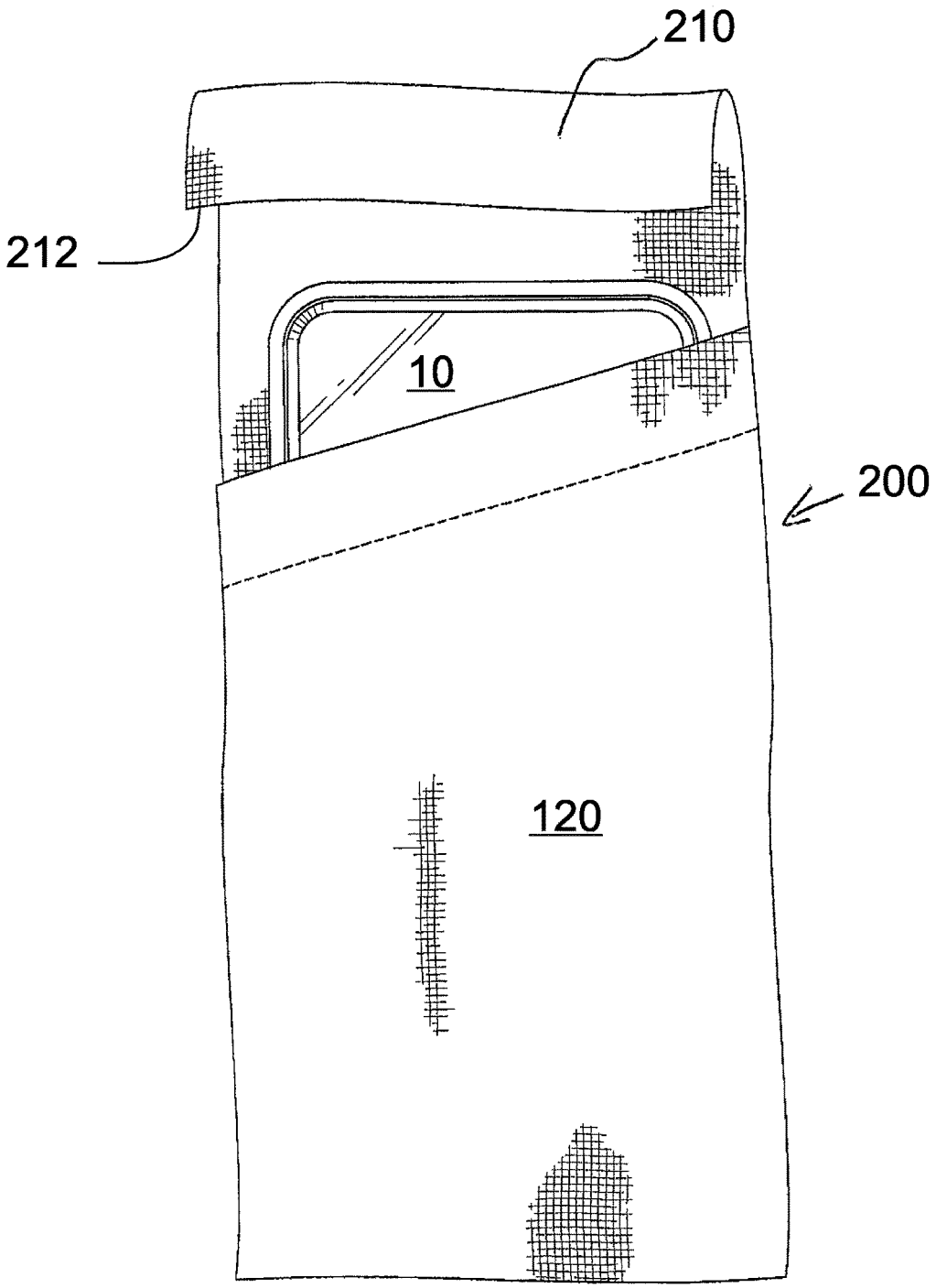
FIG. 3 is a front elevation view of a side pocket construction for a shirt according to yet another embodiment in an opened position.
Figure 4:
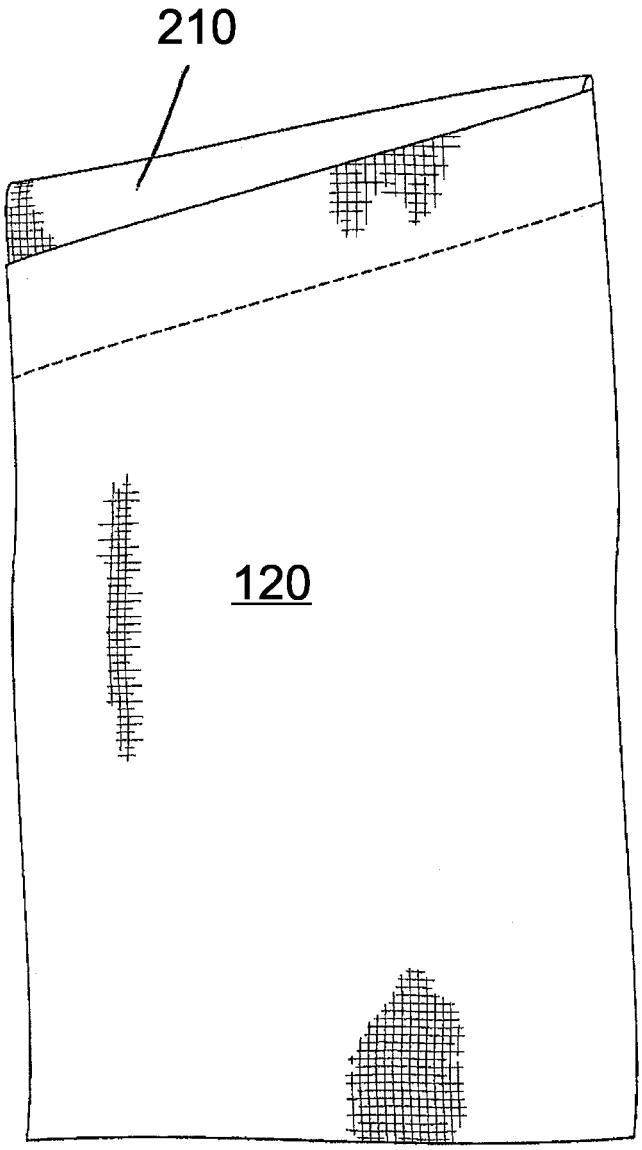
FIG. 4 is a front elevation view of the side pocket construction of FIG. 3 in a closed position.

FIGS. 3-4 show a side pocket 200 according to another embodiment. It will be understood that FIGS. 3-4 show only the side pocket 200; however, it will be understood that the side pocket 200 is part of a shirt and is positioned along the side of the shirt under the arm pit as shown in FIG. 1.

The side pocket 200 is of a flap type in that it includes a flap 210 in addition to the panel 120. The flap 210 can be formed of the same material as the panel 120 and/or shirt or can be formed of a different material. The flap 210 can be a piece of material that is affixed to the underlying shirt material and constructed such that it can be folded over and a bottom edge 212 thereof can be inserted into the side pocket 200. FIG. 4 shows the flap 210 being folded over a mobile device that is within the side pocket 200. The mobile device is thus inserted into the pocket and then the flap 210 is folded over the mobile device. The flap 210 can be tucked behind or in front of the mobile device, thereby securing it in place.

Figure 5:
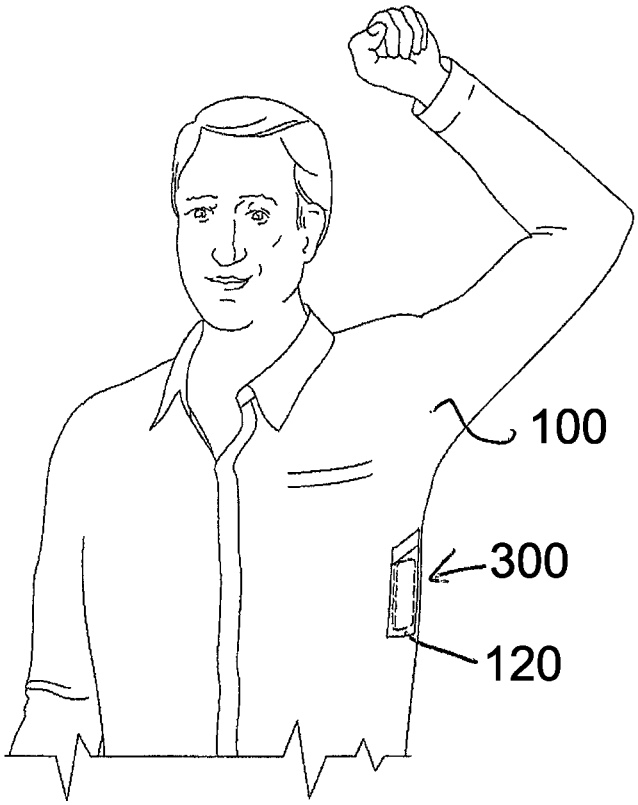
FIG. 5 is a front perspective view of a shirt showing a side pocket construction according to another embodiment of the present invention.
Figure 6:
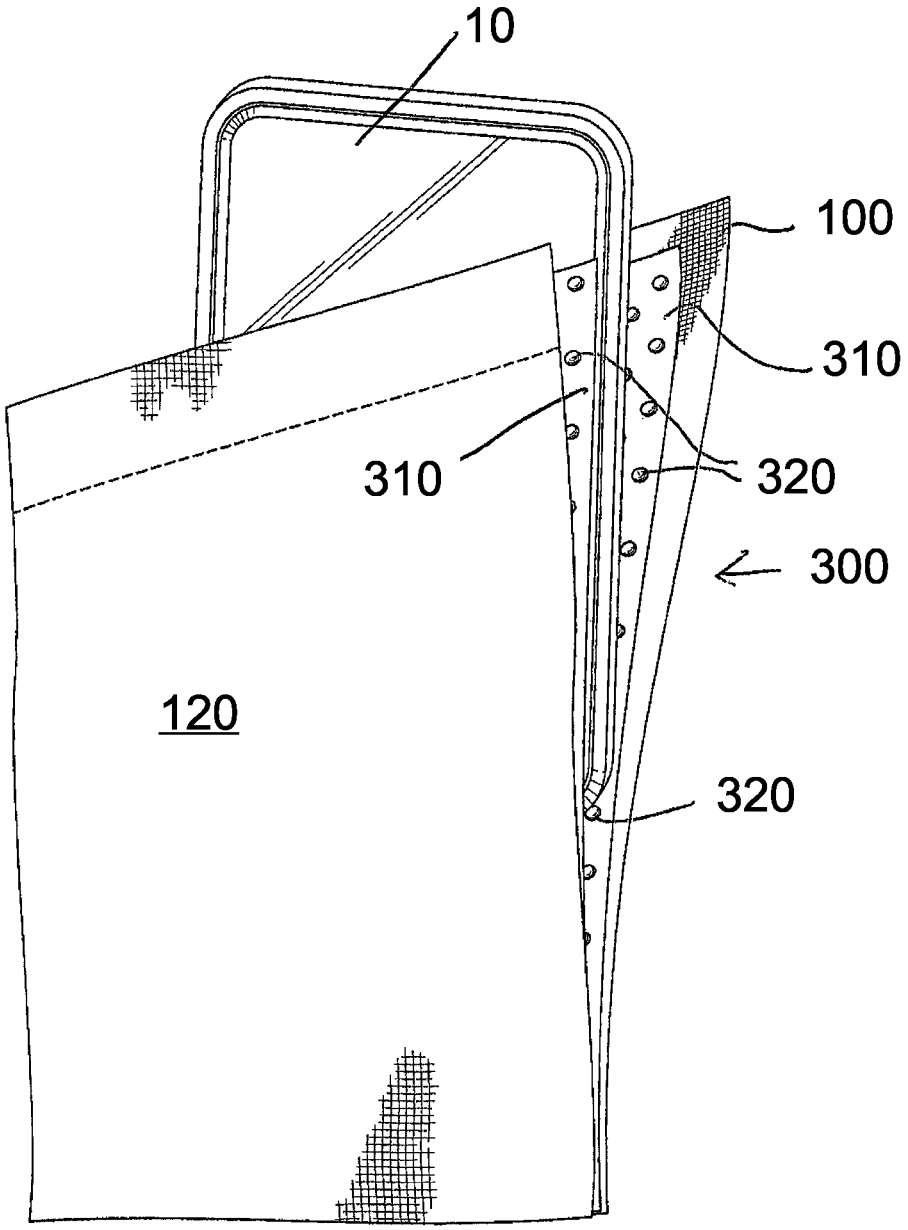
FIG. 6 is a front elevation view of the side pocket construction of FIG. 5.

FIGS. 5-6 show a side pocket 300 according to another embodiment.

The side pocket 300 is constructed such that it has non-slip properties which are particularly useful when a mobile device is inserted into the side pocket 300 without the use of a protective case. The side pocket 300 includes panel 120 and also includes one or more pieces of fabric 310 that has non-slip properties. For example, in one construction, a first (inner) piece of fabric 310 can be attached to the shirt and a second (outer) piece of fabric 310 can be attached to the inner surface of the panel 120 to line both inner surfaces of the pocket 300 with non-slip fabric. In another embodiment, only a single piece of fabric 310 is used in the pocket construction. For example, the piece of fabric 310 can be disposed on either the shirt material or the inner surface of the panel 120 within the pocket or can be disposed on both.

The non-slip properties can be provided by formation of a texture on the piece of fabric 310. For example, the fabric 310 can include a plurality of small rubber elements 320 (e.g., dots) formed across the surface of the fabric 310. These dots 320 provide a gripping surface.

Alternatively, the material of the fabric 310 itself provides the non-slip properties. For example, a rubber material can be used as layer 310.

It will also be understood that additional layers of fabric can be used in the pocket construction. For example, an impact absorbing material (layer) can be used between the fabric layer 310 and the shirt and/or panel 120. For example, an impact absorbing material can be provided below the panel 120 and a non-slip layer 310 can be provided on the shirt material (and be closest to the body).

It will also be appreciated that a padded material can be used in the construction of the side pocket of the present invention in that the inner surface of the panel 120 and/or the outer surface of the shirt 100 can including a layer of material that provides padding (comfort) or other property such as waterproofing or water resistance.

Figure 7:
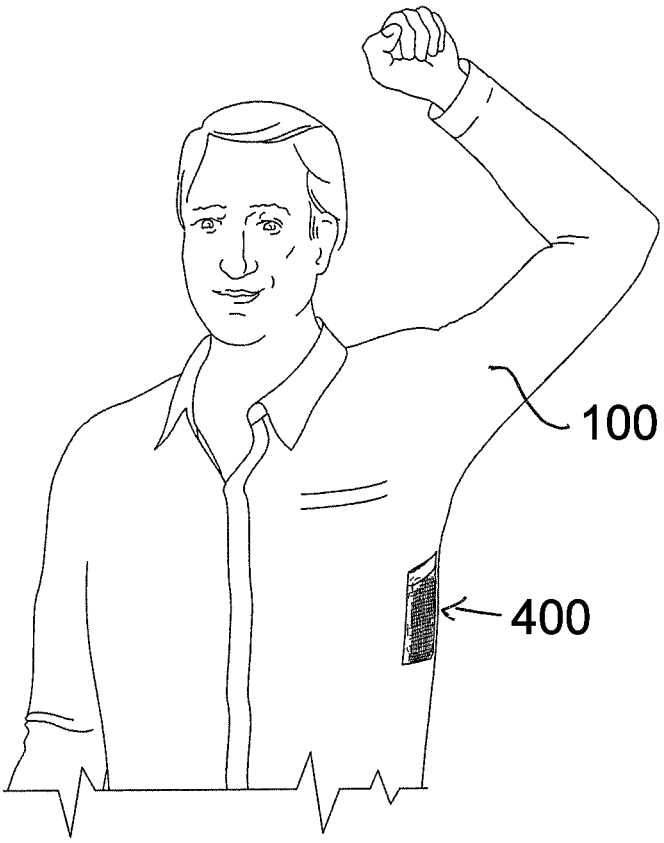
FIG. 7 is a front perspective view of a shirt showing a side pocket construction according to one embodiment of the present invention.
Figure 8:
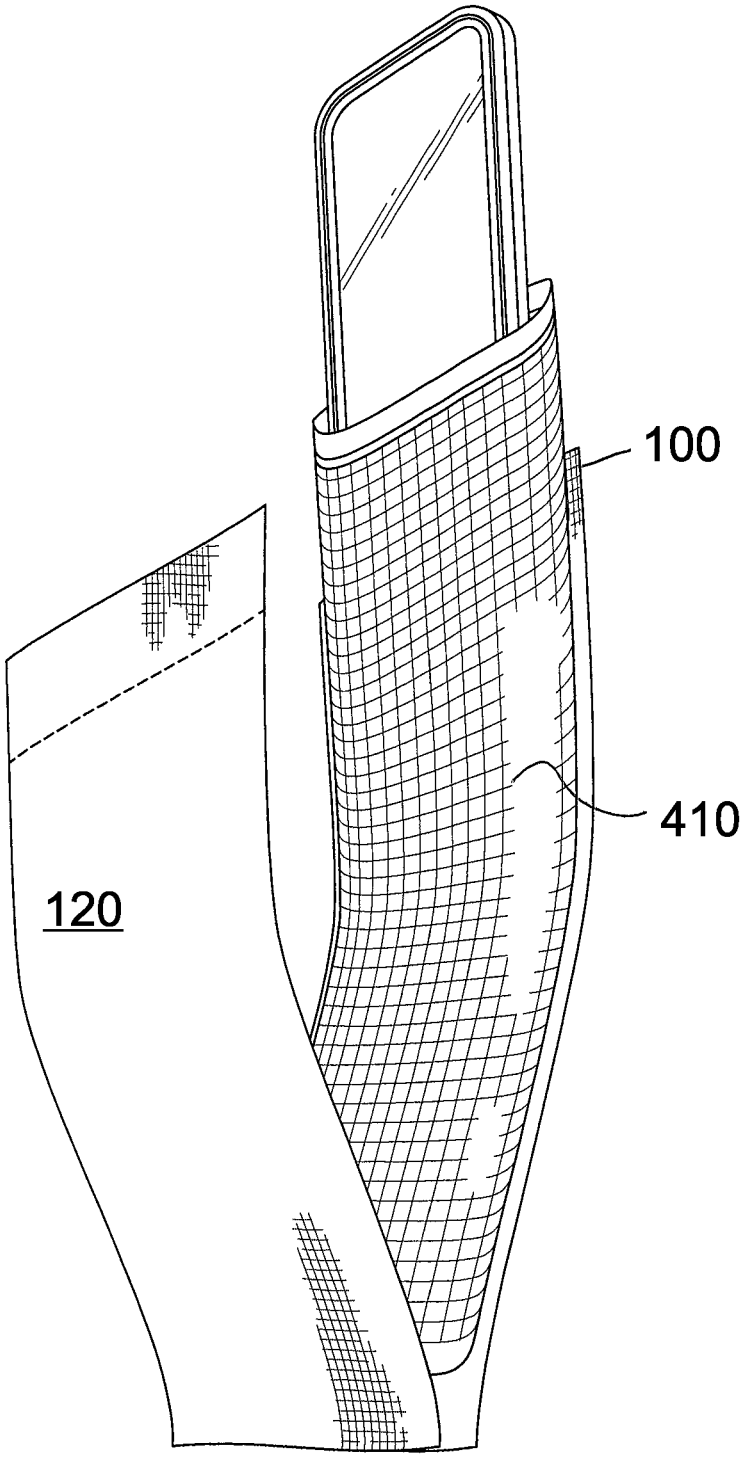
FIG. 8 is a front elevation view of the side pocket construction of FIG. 7.

Now turning to FIGS. 7-8 in which a side pocket 400 of another embodiment is shown. The side pocket 400 includes an additional inner sleeve 410. The inner sleeve 410 can be in the form of an elongated structure that includes an open end that receives the mobile device. The inner sleeve provides an additional layer of material that protects the mobile device. The inner sleeve 410 can be either removable from the side pocket 400 or can be at least partially secured within the side pocket 400 (e.g., a bottom portion of the inner sleeve 410 can be securely attached to the panel 120 and/or the shirt 100. The inner sleeve 410 can be configured such that once the mobile device is within the inner sleeve 410, the inner sleeve 410 is folded over one or more times. The folds are pushed down into the main pocket (side pocket 400) behind the mobile device itself. The snail shell folding produces a dust and watertight seal. While not as easy to access the mobile device, the inner sleeve 410 safely protects the mobile device well for users, such as sandblasters, dry wallers, road workers, asphalt men, etc. The inner sleeve 410 can be formed of any number of different types of materials including but not limited to coated fabrics, cushioned fabrics, and waterproof materials.

For example, the inner sleeve 410 can be formed of a waterproof material that is flexible. In addition, the inner sleeve 410 can be constructed as a secondary pocket structure that has a closed bottom and closed sides. In one embodiment, only the closed bottom is securely attached to the side pocket 400 (i.e., to the panel 120 and/or the shirt 100).

Figure 9:
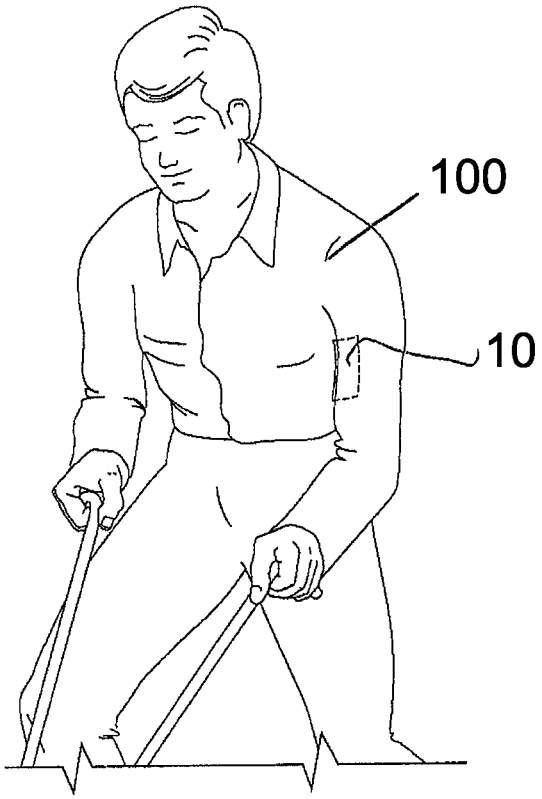
FIG. 9 is a front perspective view of illustrating the use of one of the shirt side pocket constructions disclosed herein.
Figure 10:
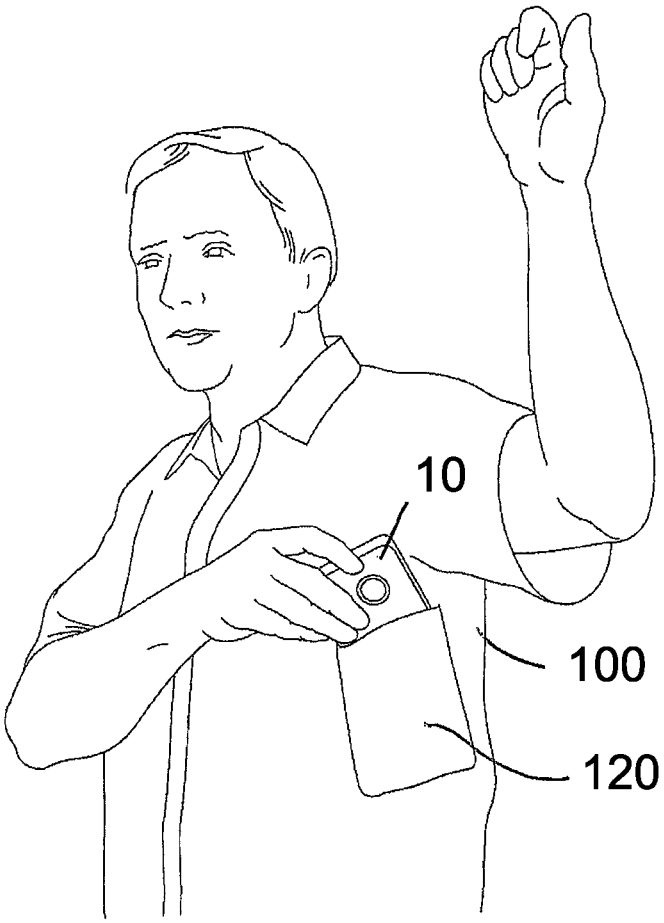
FIG. 10 is a front perspective view showing a user inserting a mobile device into a side pocket construction.

FIGS. 9 and 10 illustrate shirt 100 in accordance with one of the embodiments disclosed herein during use. As described and illustrated herein, the shirt 100 contains the mobile device 10 during movements of the wearer including leaning forward and as the wearer performs work including lifting, pulling, etc.

Figure 11:
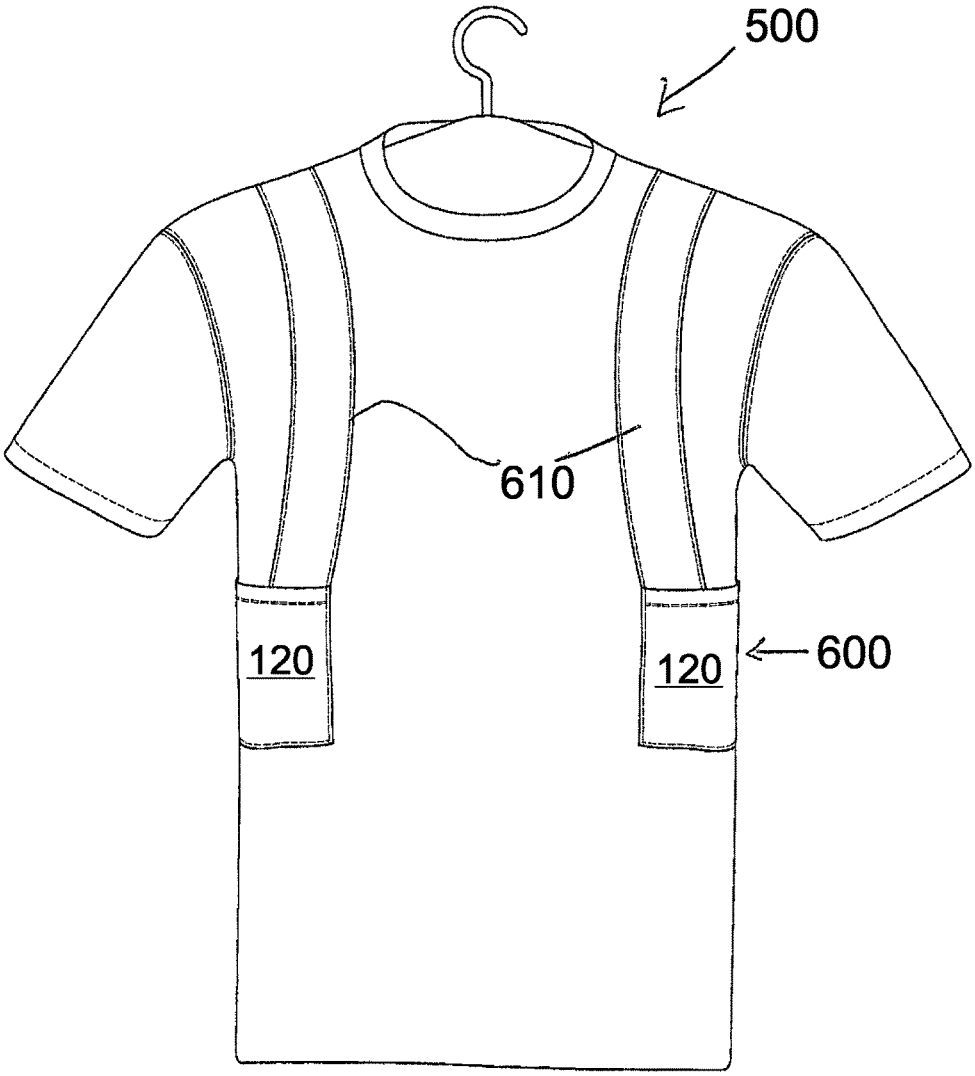
FIG. 11 is a front elevation view of a T-shirt having a side pocket construction in accordance with the present invention.
Figure 12:
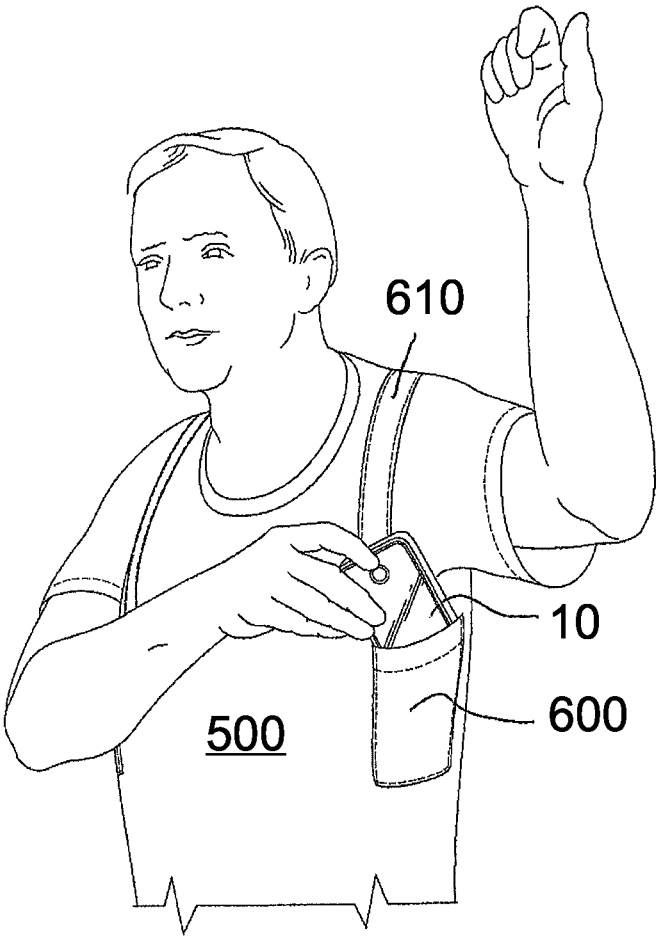
FIG. 12 is a perspective view of the T-shirt of FIG. 11 showing a mobile device being inserted into the side pocket.

FIGS. 11 and 12 show a shirt 500 that is in the form of a T-shirt (tee-shirt). As will be appreciated, a T-shirt 500 has a more causal construction compared to dress shirt 100. The T-shirt 500 includes a side pocket 600 that is defined by panel 120. The side pocket 600 is located in the same location as the other side pockets disclosed herein. In contrast to the side pocket 100, the side pocket 600 includes a reinforcing element 610 in the form of a strip of material that extends from the side pocket 600 to the shoulder section of the T-shirt 500. The reinforcing element 610 provides a more robust shirt construction which is desired when the shirt is in the form of a T-shirt and provides additional structural support which is desired. More specifically, the structure of the reinforcing element 610 transfers the weight of the mobile device up to the shoulder region of the T-shirt 500.

In the illustrated embodiment, the reinforcing element 610 is in the form of an elongated reinforcing element 610 that can have a curved shape as shown. One end of the reinforcing element 610 can terminate internally within the side pocket or at or proximate to the top opening of the side pocket. The other end of the reinforcing element 610 can extend across the shoulder area and down the rear of the T-shirt 100 and can terminate back at the side pocket 600. The reinforcing element 610 is in the form of a strip of fabric and can be formed of the same material that is used to form the T-shirt 500 or can be formed of a different material. The material used to form the reinforcing element 610 can have different properties such as being elastic, etc.

The T-shirt 500 also has two side pockets 600. The two side pockets 600 fits lefties as well as righties and the second side pocket is also useful for an ID, cash, debit card, wallet, etc.

Figure 13:
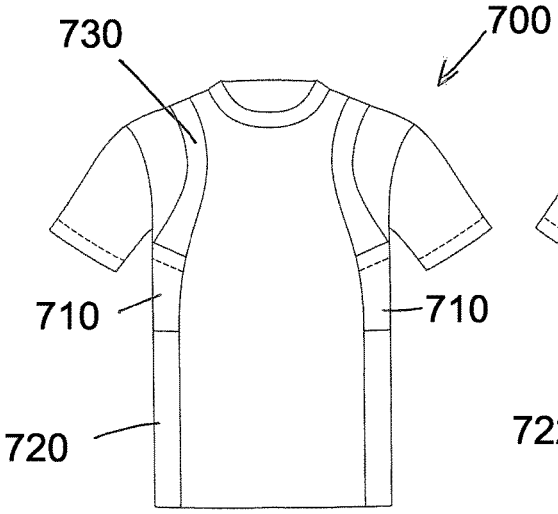
FIG. 13 is a front elevation view of a T-shirt having a side pocket construction in accordance with another embodiment of the present invention.
Figure 14:
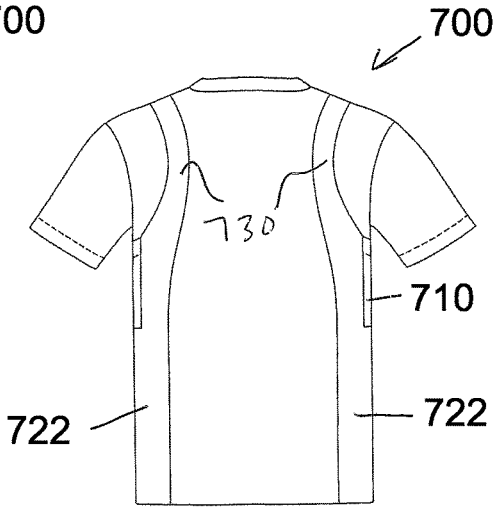
FIG. 14 is a rear elevation view of the T-shirt of FIG. 13.
Figure 15:
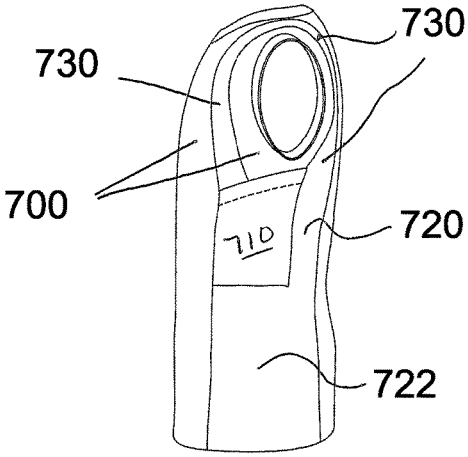
FIG. 15 is a side view of the T-shirt of FIG. 13.

FIGS. 13-15 illustrate a T-shirt 700 according to the invention. The T-shirt 700 includes a side pocket 710 similar to T-shirt 500. The T-shirt 700 also includes a reinforcing element 720 similar to reinforcing element 610; however, as shown, the reinforcing element 720 can occupy a substantial area of the side of the T-shirt 700 as well as extending across the shoulder. In particular, the reinforcing element 720 can include base section 722 that occupies the side of the T-shirt 700 and can extend to the bottom edge of the T-shirt 700. The side pocket 710 can be located within the base section 722. The reinforcing element 720 can include an upper portion 730 in the form of a strip that extends from the upper edge of the side pocket 710 up across the shoulder and back down to the upper edge of the side pocket 710. In this embodiment, the reinforcing element 720 lies underneath the side pocket.

The reinforcing element 720 can be formed of a material that is different than the T-shirt and serves to provide shirt stability since T-shirts are typically made of material that stretches a lot. The reinforcing element 720 thus can be formed of a material that adds some rigidity to the shirt construction (i.e., material that is less elastic than the T-shirt material while still being comfortable, etc.). A compression type fabric may be used.

It will be appreciated that any of the side pocket constructions disclosed herein can include one or more fasteners to allow the side pocket to be closed. For example, the fastener can be a mechanical fastener, such as a zipper, button, snap, or hook and loop material.

In the illustrated embodiment, the side pocket 110 is shown on the left side of the dress shirt; however, the side pocket 110 can equally be formed on the right side. In addition, the shirt 100 can have side pockets 110 on both the left and right sides according to one embodiment similar to the T-shirt 500.

It will also be appreciated that any of the product embodiments illustrated in FIGS. 1-8 can be implemented in the shirt construction shown in FIGS. 13-15. For example, the inner sleeve construction (FIG. 8); the tactile features (FIG. 6); transparent window (FIG. 2); etc.

What is claimed is:

1. A shirt comprising:

a body having a front panel and a rear panel joined together along first and second side seams; and a side pocket formed along the first seam and located below a corresponding armhole to which a sleeve is attached, the side pocket being defined by a front pocket panel that is attached to the front and rear panels and extends across the first seam;

wherein the side pocket includes a rear pocket panel that is attached to the front pocket panel to form the side pocket therebetween, the rear pocket panel having a greater height than the front pocket panel so as to form a top flap that can close off and cover an entrance to the side pocket by being tucked between the rear pocket panel and the front pocket panel.

2. A shirt comprising:

a body having a front panel and a rear panel joined together along first and second side seams;

a side pocket formed along the first seam and located below a corresponding armhole to which a sleeve is attached, the side pocket being defined by a front pocket panel that is attached to the front and rear panels and extends across the first seam; and a waterproof inner sleeve disposed within the side pocket between the front pocket panel and the front panel, the inner sleeve defining a pocket.

3. The shirt of claim 1, wherein the shirt comprises a dress shirt with a collar.

4. A shirt comprising:

a body having a front panel and a rear panel joined together along first and second side seams; and a side pocket formed along the first seam and located below a corresponding armhole to which a sleeve is attached, the side pocket being defined by a front pocket panel that is attached to the front and rear panels and extends across the first seam;

wherein the shirt includes first and second reinforcing elements, the first reinforcing element being disposed along a left side of the body of the shirt and the second reinforcing element being disposed along a right side of the body of the shirt, the side pocket being disposed along one of the first and second reinforcing elements.

5. The shirt of claim 4, wherein each of the first and second reinforcing elements comprises a compression material attached to the body, the compression material having less elasticity than the body.

6. The shirt of claim 4, wherein each of the first and second reinforcing elements includes a base section that extends along a side of the body below the armhole and an upper section that is in the form of a loop that extends up and across a shoulder of the body.

7. The shirt of claim 6, wherein the upper section is disposed above the side pocket.

8. The shirt of claim 4, wherein there is a pair of side pockets, one on each side of the body of the shirt.

9. The shirt of claim 6, wherein the base section extends along both the front panel and the rear panel and a front portion of the upper section extends along the front panel and a rear portion of the upper section extends along the rear panel.

10. A shirt comprising:

a body having a front panel and a rear panel joined together along first and second side seams; and a side pocket formed along the first seam and located below a corresponding armhole to which a sleeve is attached, the side pocket being defined by a front pocket panel that is attached to the front and rear panels and extends across the first seam;

first and second reinforcing elements disposed along the first and second side seams respectively, each of the first and second side reinforcing elements including a lower section in which the side pocket is contained and an upper section that extends along the front panel across a shoulder and then along the rear panel, each of the first and second side reinforcing elements being formed of a material that is less elastic than a material of the body.

* * * * *